US005637157A

United States Patent [19]

Takashima et al.

[11] Patent Number: 5,637,157

[45] Date of Patent: Jun. 10, 1997

[54] METHOD FOR MAKING NON-ORIENTED MAGNETIC STEEL SHEET

[75] Inventors: Minoru Takashima, Okayama; Atsushi Ogino, Chiba; Keiji Sato, Okayama, all of Japan

[73] Assignee: Kawasaki Steel Corporation, Japan

[21] Appl. No.: 533,842

[22] Filed: Sep. 26, 1995

[30] Foreign Application Priority Data

Sep. 29, 1994 [JP] Japan ..... 6-235419

[51] Int. Cl.[6] ..... H01F 1/14

[52] U.S. Cl. ..... 148/120; 148/111

[58] Field of Search ..... 148/111, 120

[56] References Cited

U.S. PATENT DOCUMENTS

| | | | |
|---|---|---|---|
| 3,188,250 | 6/1965 | Holbein et al. | 148/120 |
| 5,164,024 | 11/1992 | Nishimoto et al. | 148/111 |
| 5,169,457 | 12/1992 | Nishimoto et al. | 148/111 |
| 5,186,763 | 2/1993 | Kubota et al. | 148/111 |

FOREIGN PATENT DOCUMENTS

| | | | |
|---|---|---|---|
| 0 098 324 A1 | 1/1984 | European Pat. Off. . | |
| 0511601 | 11/1992 | European Pat. Off. | 148/111 |
| 2 643 387 | 8/1990 | France . | |
| 60-258414 | 12/1985 | Japan . | |
| 62-222022 | 9/1987 | Japan | 148/111 |
| 3053022 | 7/1991 | Japan . | |
| 6220537 | 9/1994 | Japan . | |

*Primary Examiner*—John Sheehan
*Attorney, Agent, or Firm*—Austin R. Miller

[57] ABSTRACT

This invention is directed to a method of producing a non-oriented magnetic steel sheet involving a series of processes including performing hot rolling process on a steel slab containing no more than about 0.01 wt % C, no more than about 4.0 wt % Si, no more than about 1.5 wt % Mn, no more than about 1.5 wt % Al, no more than about 0.2 wt % P, and no more than about 0.01 wt % S, performing thereto at least one cold rolling process including an optional intermediate annealing process, and then performing a finishing annealing process. The hot rolling process further includes a step which reduces thermal irregularity formed during slab heating; this step involves maintaining a sheet bar, obtained by rough-rolling of the steel slab, at a temperature ranging from about 850° to 150° C. The hot rolling process also includes a step which promotes the growth of fine precipitated particles by applying strain to the sheet bar. Magnetic steel sheet thusly obtained possess uniform magnetic properties and thickness in the coil.

6 Claims, 4 Drawing Sheets

METHOD FOR MAKING NON-ORIENTED MAGNETIC STEEL SHEET

BACKGROUND OF THE INVENTION

1. Field of the Invention

The present invention relates to a method for making a non-oriented magnetic steel sheet having uniform magnetic characteristics and sheet shape in the coil product.

2. Description of the Related Art

Non-oriented magnetic steel sheets have been used in motors, dynamo-electric generators, and cores of transformers. Low core loss and high magnetic flux density are important magnetic properties required of non-oriented magnetic steel sheets, as these properties enhance the energy characteristics of the above-described devices.

A demand for less irregularity in motor characteristics has coincided with the recent development of motors which are highly controllable through integrated circuits. Thus, non-oriented magnetic steel sheets which possess uniform magnetic characteristics and sheet shape, especially sheet thickness in the coil product of a non-oriented magnetic steel sheet, are in great demand as motor core materials.

As a prior art method of producing uniform sheet thickness in the coil product, Japanese Patent Publication No. 57-60408 discloses a method which involves maintaining the finishing temperature of the hot rolling process within the α-phase temperature range. Furthermore, Japanese Patent Laid-Open No. 5-140649 discloses a steel containing extremely low quantities of N and S as a method of producing uniform sheet thickness in the coil product. However, these prior art techniques cannot produce the uniformity presently demanded, thus there remains a great need for marked improvement.

SUMMARY OF THE INVENTION

It is an object of this invention to provide a method of producing a non-oriented magnetic steel sheet having uniform magnetic properties and uniform thickness in the coil product.

This invention is directed to a method for producing a non-oriented magnetic steel sheet which includes hot rolling a steel slab containing no more than about 0.01 wt % C, no more than about 4.0 wt % Si, no more than about 1.5 wt % Mn, no more than about 1.5 wt % Al, no more than about 0.2 wt % P, and no more than about 0.01 wt % S, performing at least one cold-rolling process including an optional intermediate annealing process, and then performing a finishing annealing process. The hot-rolling process includes a step which reduces thermal irregularity formed during slab heating. The step involves forming a sheet bar by rough-rolling the steel slab, and thereafter holding the sheet bar at a temperature ranging from about 850 to 1,150° C. The hot-rolling process also includes a step which promotes the growth of fine precipitated particles by applying strain to the sheet bar.

This invention is further directed to a method for producing a non-oriented magnetic steel sheet which includes hot rolling a steel slab containing no more than about 0.01 wt % C, no more than about 4.0 wt % Si, no more than about 1.5 wt % Mn, no more than about 1.5 wt % Al, no more than about 0.2 wt % P, and no more than about 0.01 wt % S, performing at least one cold-rolling process including an optional intermediate annealing process, and then performing the finishing annealing process. The hot-rolling process further includes the steps of: coiling a sheet bar, obtained by rough-rolling the steel slab, into a coil having an inside diameter of at least about 100 mm and an outside diameter of no more than about 3,600 mm at a temperature ranging from about 850° to 1,150° C.; uncoiling the coil; and performing a finishing hot rolling.

According to the invention, the coiling of the sheet bar is preferably performed at a temperature T (° C.) satisfying the following equation (1):

$$900.31 - 2.0183T + 1.4139 \times 10^{-3}T^2 - 3.0648 \times 10^{-7}T^3 - 326.7[\text{C wt \%}] + 11.8[\text{Si wt \%}] - 12.2[\text{Mn wt \%}] + 39.7[\text{P wt \%}] + 22.8[\text{Al wt \%}] > 0 \quad (1)$$

Furthermore, a light rolling step involving about a 3 to 15% rolling reduction is preferably performed after the finishing annealing process in order to improve the magnetic properties.

DETAILED DESCRIPTION OF THE PREFERRED EMBODIMENTS

Figure 1:
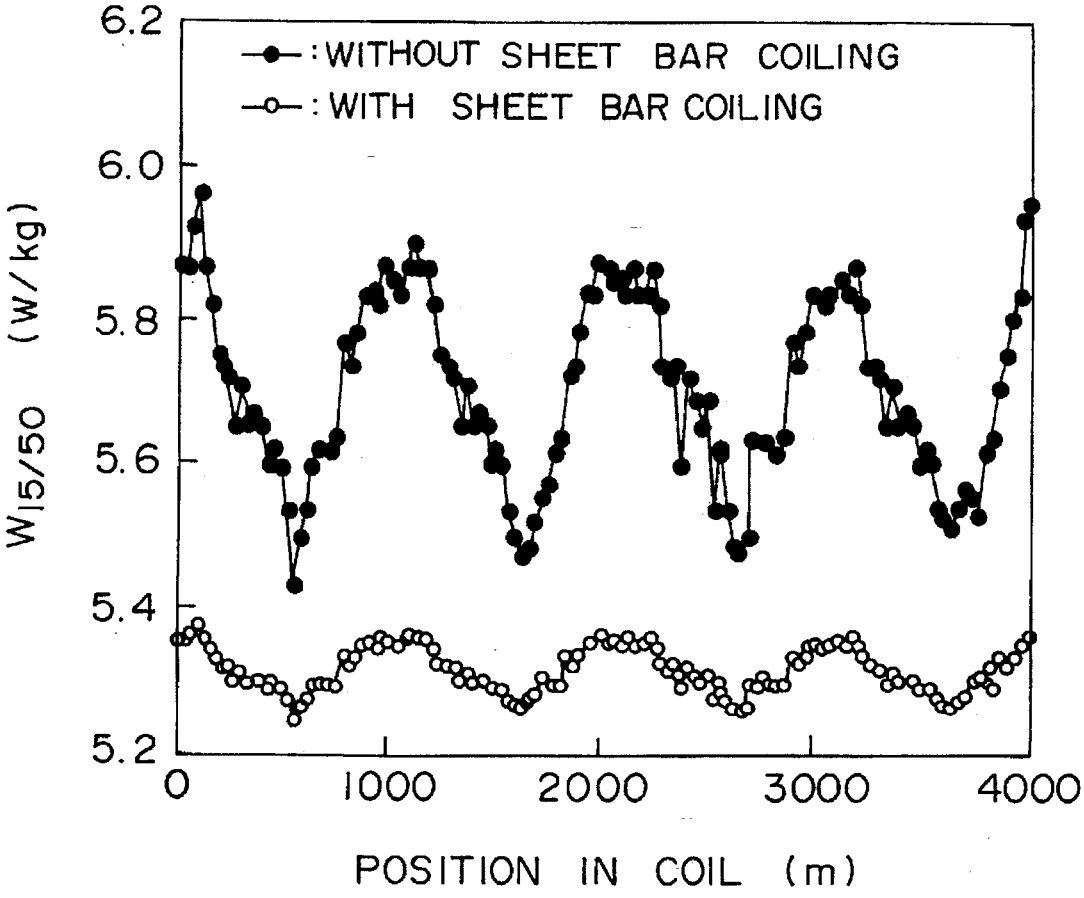
FIG. 1 is a graph illustrating the effect of sheet bar coiling on core loss.

The results of the experiments which led to the discovery of the present invention will be explained in detail below.

Two steel slabs obtained by a continuous casting process and containing 0.003 wt % C, 0.4 wt % Si, 0.2 wt % Mn, 0.25 wt % Al, 0.05 wt % P, 0.005 wt % S, and the balance substantially Fe were heated to 1,150° C. and roughly rolled so as to form sheet bars 30 mm thick. One of the sheet bars was immediately processed into a hot-rolled sheet by a finishing hot rolling. Another sheet bar was wound at 970° C. into a coil having an inside diameter of 500 mm and an outside diameter of 1,400 mm, unwound and finish hot-rolled to form another hot-rolled sheet. The final temperature during the finish hot rolling of each sample was 840° C. Each hot-rolled sheet was cold-rolled to a thickness of 0.5 mm, and continuously annealed at 770° C. for 30 seconds, then the thickness and magnetic properties in the longitudinal direction of each coil were measured.

The evaluations of the magnetic properties and coil thickness were carried out at 30 m intervals on each coil product length, and the final results were determined by arithmetic average (X) and standard deviation σ as defined by the following equations (2) and (3):

$$(X) = \frac{\Sigma X_1}{n} \quad (2)$$

$$\sigma = \sqrt{\frac{\Sigma\{X_1 - (X)\}^2}{n}} \quad (3)$$

where $X_i$ represents a core loss $W_{15/50}$ measurement or a thickness measurement, and n represents the number points on the coil from which the measurements were taken (n=133 in the experiments).

In FIG. 1, blackened circles represent the results obtained from the conventionally-produced coil, i.e., the coil produced without winding (coiling) the sheet bar. FIG. 1 reveals that the core loss of the conventionally-produced coil significantly fluctuates at different positions on the coil. It was discovered that the positions on the coil which exhibited poor core loss corresponded to the positions between skids which were heated to a high temperature during the slab heating (a skid is a member supporting the slab in the slab heating furnace, and is usually cooled by water).

Because non-homogeneous precipitated particles which worsen core loss values (i.e. increase core loss) are readily formed at higher slab heating temperatures, more non-homogeneous precipitated particles will be produced between skids (i.e., high temperature slab sections) during slab heating than at skid contact sections (i.e., low temperature slab sections) during the slab heating. Therefore, core loss values between skids are worse (higher) than core loss values at each skid contact section.

The empty circles in FIG. 1 represent the results obtained from the coil produced with sheet bar coiling. FIG. 1 shows that there is less core loss fluctuation in the coil produced with sheet bar coiling as compared with the coil produced conventionally, i.e., without sheet bar coiling.

The results of the magnetic property and thickness evaluations are shown in Table 1. The process of winding the sheet bar after rough-rolling minimized standard deviations of the magnetic properties and thickness. Further, excellent average magnetic properties were achieved as compared with the conventional process in which the sheet bar was rolled immediately after the rough-rolling.

The thickness fluctuations in the coil produced by the conventional process (without sheet bar coiling) is due to the variable resistance to deformation across the hot-rolled sheet during finishing rolling. This variable resistance results from the temperature difference during slab heating between the skid section and the intermediate section between skids.

TABLE 1

| | Magnetic Induction $B_{50}$ (T) | | Core Loss $W_{15/50}$ (W/kg) | | Sheet Thickness (mm) | | Number of Measuring Points |
|---|---|---|---|---|---|---|---|
| | (X) | σ | (X) | σ | (X) | σ | n |
| Without Sheet Bar Coiling | 1.751 | 0.004 | 5.706 | 0.122 | 0.50 | 0.003 | 133 |
| With Sheet Bar Coiling | 1.762 | 0.001 | 5.315 | 0.031 | 0.50 | 0.001 | 133 |

FIG. 1 and Table 1 clearly demonstrate that magnetic properties are improved and that both magnetic properties and thickness become uniform in a coil by winding the sheet bar after rough-rolling.

Possible mechanisms behind these improvements are as follows:

(1) temperature fluctuation within the sheet bar during slab heating can be reduced by winding the sheet bar; and/or (2) strain caused by sheet bar coiling can promote the growth of fine precipitated particles.

Thus, the present invention is not limited to the winding or coiling of the sheet bar, but encompasses a hot-rolling process which reduces the temperature fluctuation in a sheet bar formed during a steel slab rough-rolling process by maintaining the sheet bar at a temperature ranging from about 850° to 1,150° C., and which promotes the growth of fine precipitated particles in the sheet bar by applying strain to the sheet bar. As an example of means other than sheet bar coiling through which the invention may be accomplished, a method which places a sheet bar in a heat maintaining furnace after applying about 0.5 to 5% strain by rolling can be used. However, this method requires a long furnace which can receive the sheet bar without coiling.

Figure 2A:
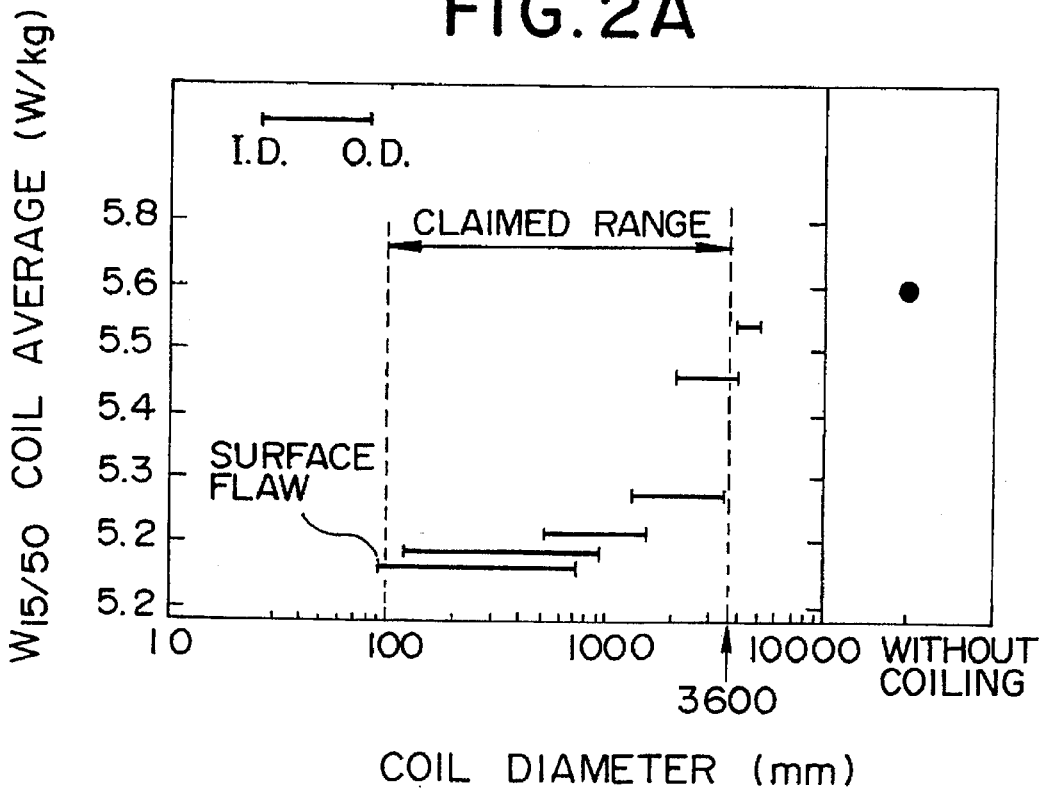
FIG. 2A and 2B are diagrams illustrating the effect of coil shape on magnetic properties.
Figure 2B:
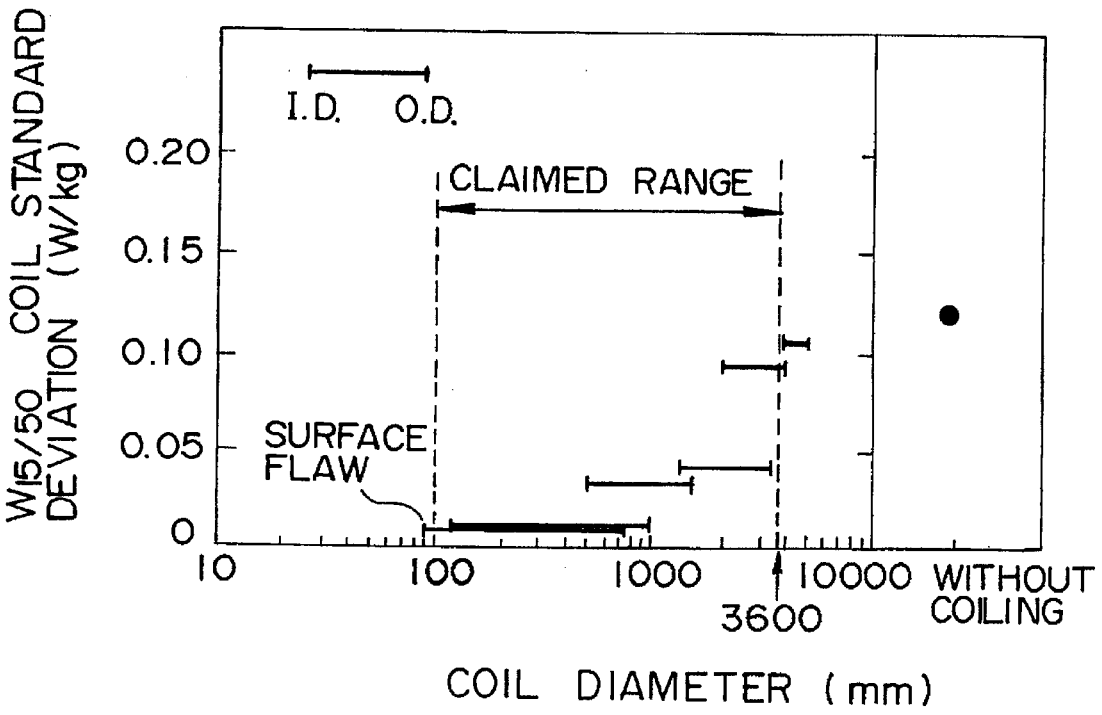

We conducted several investigations regarding the shape of the sheet bar. FIG. 2 shows the effects of the inside and outside diameter of the coil on magnetic properties.

An outside diameter over about 3,600 mm causes an increased core loss average and a greater core loss standard deviation within a coil. Please refer to FIG. 2A and 2B, respectively.

A larger outside diameter promotes non-uniform temperature and results in less strain being incorporated into the sheet bar during winding, thus precipitated particle growth may be hindered. Therefore, the outside diameter of the coil should not be over about 3,600 mm in order to promote uniform temperature and increase the strain from winding. On the other hand, an inside diameter of less than about 100 mm causes some surface defects in the form of cracks on the sheet bar. Consequently, the inside diameter of the coil should be about 100 mm or more.

The results of our investigation into the effects of steel composition and sheet bar coiling temperature on the magnetic properties will be detailed below.

Three steels, A, B and C, having the compositions shown in Table 2 were melted in a converter and vacuum degassing device, and slabs were prepared by a continuous casting process. The slabs were again heated, then rough-rolled to form sheet bars 40 mm thick. After coiling the sheet bars at various temperatures, a finishing hot rolling was performed on each sample.

For the comparison, some sheet bars were hot-rolled without sheet bar coiling. The thickness of the each hot-rolled sheet after the finishing hot rolling was 2.0 mm. Then, the hot-rolled sheet was annealed at 900° C. for 1 minute, cold-rolled to be 0.5 mm thick. Thereafter, continuous finishing annealing was performed at 800° C. for 30 seconds, and an insulating coating treatment was performed to form the sheet product. The magnetic properties of test pieces cut from the plate product were evaluated through an Epstein test.

TABLE 2

| | Composition (wt %) | | | | | Sheet Bar Coiling |
|---|---|---|---|---|---|---|
| Steel | C | Si | Mn | P | Al | Temperature (°C.) |
| A | 0.003 | 0.5 | 0.25 | 0.08 | 0.25 | 908 |
| | | | | | | 950 |
| | | | | | | 985 |
| | | | | | | 1020 |
| | | | | | | 1050 |
| | | | | | | Without coiling |
| B | 0.003 | 0.25 | 0.25 | 0.08 | 0.5 | 910 |
| | | | | | | 985 |
| | | | | | | 1040 |
| | | | | | | 1050 |
| | | | | | | 1080 |
| | | | | | | Without coiling |
| C | 0.003 | 0.4 | 0.45 | 0.08 | 0.25 | 900 |
| | | | | | | 920 |
| | | | | | | 980 |
| | | | | | | 1000 |
| | | | | | | 1080 |
| | | | | | | Without coiling |

Figure 3A:
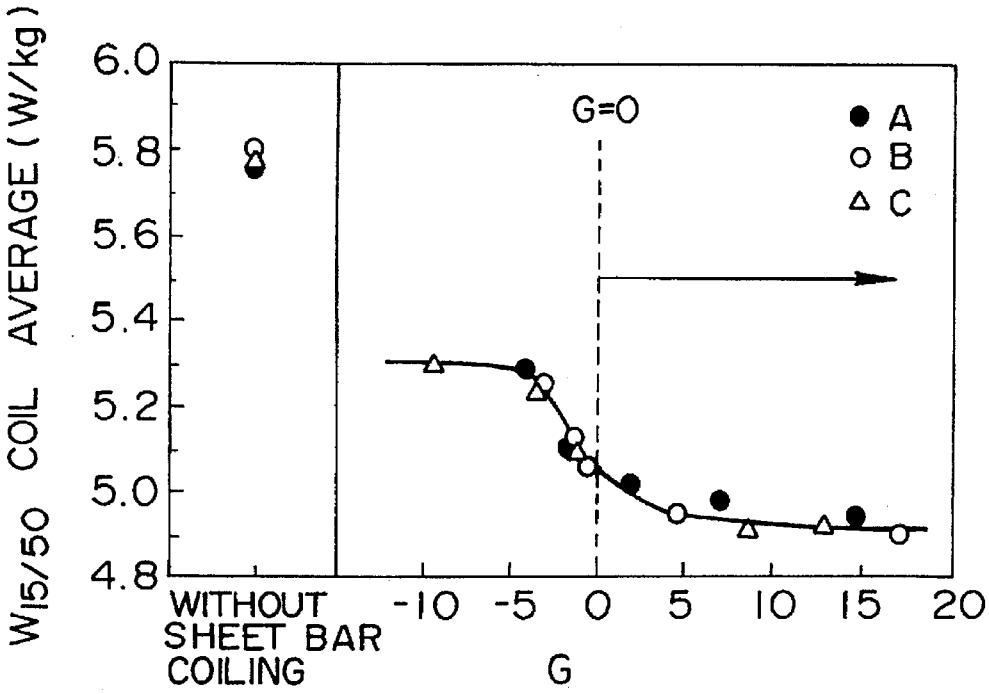
FIG. 3A and 3B are graphs showing the correlation between the α-phase stability index, G, and magnetic properties.
Figure 3B:
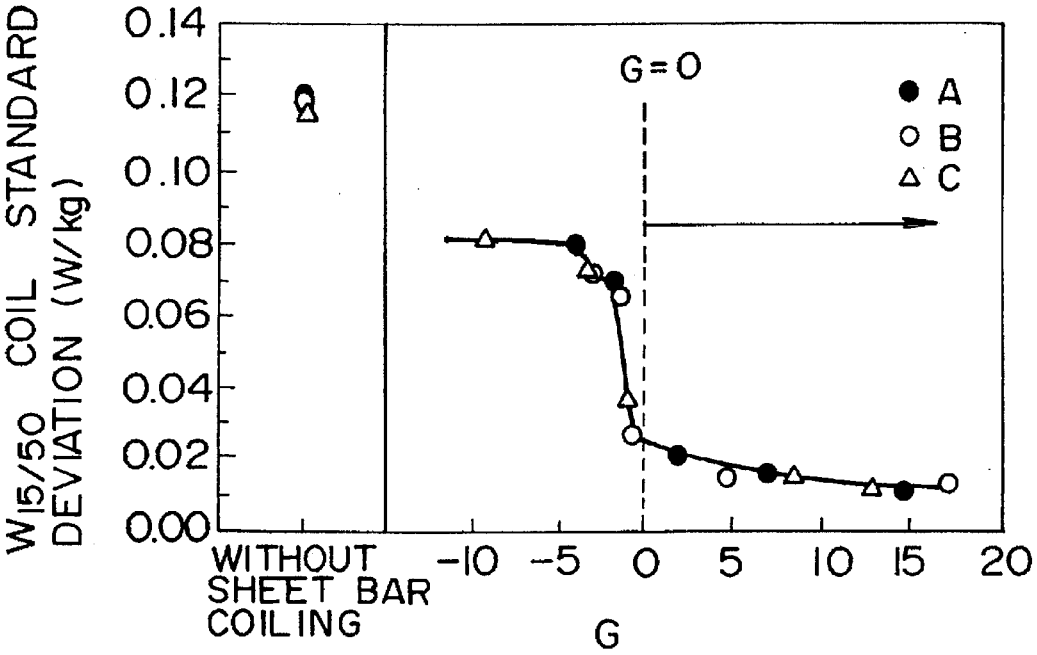

The results are plotted in FIGS. 3A and 3B. FIG. 3A illustrates the correlation between α-phase stabilizing coefficient G (calculated from the sheet bar coiling temperature, see below) and average coil core loss, while FIG. 3B shows the correlation between the α-phase stabilizing coefficient G and the core loss standard deviation of a coil.

The α-phase stabilizing coefficient G represents an index reflecting the stability of α-phase at a measured temperature. At a given temperature T (° C.), G is expressed through the following equation (1):

$$G = 900.31 - 2.0183T + 1.4139 \times 10^{-3}T^2 - 3.0648 \times 10^{-7}T^3 - 326.7[\text{C wt \%}] + 11.8[\text{Si wt \%}] - 12.2[\text{Mn wt \%}] + 39.7[\text{P wt \%}] + 22.8[\text{Al wt \%}] > 0 \quad (1)$$

Figure 4:
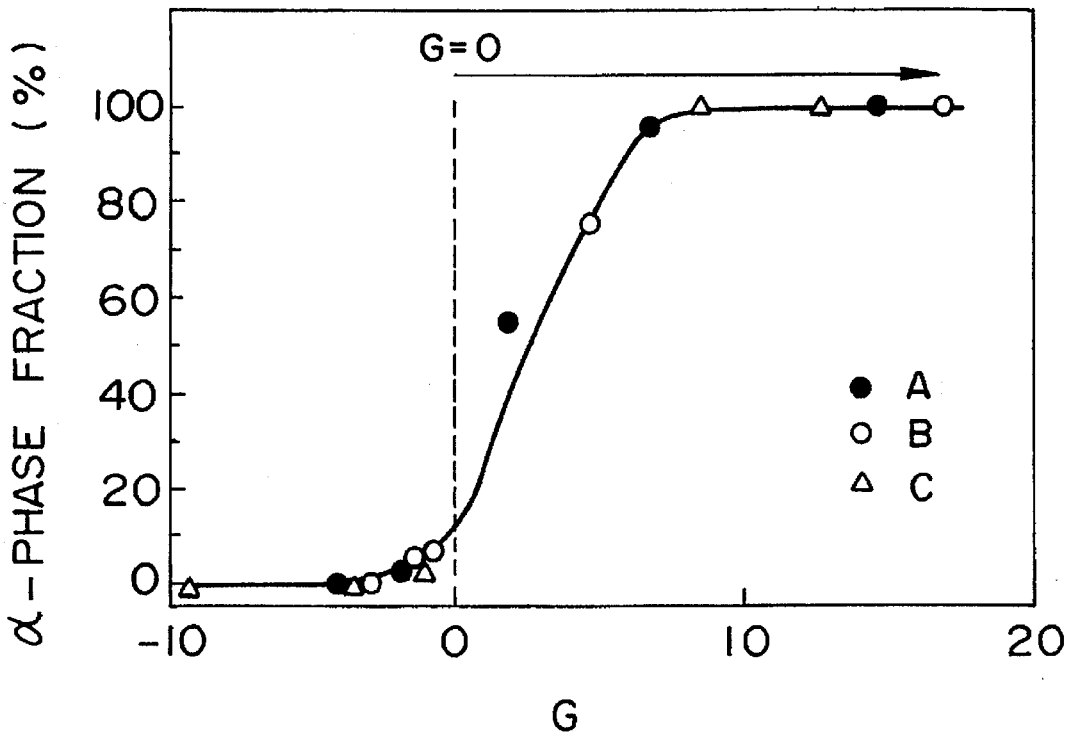
FIG. 4 is a graph showing the correlation between the α-phase stability index, G, and the α-phase fraction.

As shown FIG. 4 (discussed in detail below), G correlates well with α-phase fraction. Specifically, the α-phase fraction increases as G increases beyond 0, reflecting the stabilization of the α-phase.

On the other hand, FIG. 3 shows the significant improvement in the average core loss, $W_{15/50}$, and the core loss standard deviation g on a coil after sheet bar coiling at a temperature satisfying G>0 in equation (1). The reason for these improvements can be explained as follows.

Fine precipitated particles which are formed during rough-rolling and improve core loss values can grow by means of the sheet bar coiling. With sheet bar coiling, the diffusion rate of the α-phase is about 10 times faster than that of the γ-phase, and the diffusion is a rate-determining stage in the growth of the fine precipitated particles. Thus, higher a α-phase fraction in a sheet bar coil promotes fine precipitated particle growth, increases the improvement of in core loss values, and reduces the standard deviation among core loss values within a coil.

Accordingly, by controlling steel composition and coiling temperature so as to satisfy G>0, a non-oriented magnetic steel having uniform core loss throughout the coil can be produced.

The steel composition of the invention and a process illustrating the invention will now be explained in detail.

C content should be not more than about 0.01 wt %. When the C content exceeds about 0.01 wt %, magnetic properties deteriorate due to C precipitation. The lower C content limit should be about 0.0001 wt % in view of economic feasibility.

Si content should be not more than about 4.0 wt %. Although Si is a useful component for increasing specific resistance and decreasing core loss, an Si content over about 4.0 wt % causes poor formability during cold rolling. The lower limit is preferably set to about 0.05 wt % to ensure satisfactory specific resistance.

Mn content should be not more than about 1.5 wt %. Although Mn is a useful component for increasing specific resistance and decreasing core loss, costs become prohibitively high when Mn content exceeds about 1.5 wt %. On the other hand, Mn can fix S as MnS, S being otherwise harmful to magnetic properties. Therefore, the lower limit of Mn is preferably set to about 0.1 wt % to ensure satisfactory magnetic properties.

Al content should be not more than about 1.5 wt %. Although Al is a useful component for increasing specific resistance and decreasing core loss, an Al content over about 1.5 wt % causes poor formability during cold rolling.

P content should be not more than about 0.2 wt %. Although P can be added to improve blanking ability, a P content over about 0.2 wt % causes poor formability during cold rolling. The lower P content limit should be about 0.0001 wt % in view of economic feasibility.

S content should be not more than about 0.01 wt %. Because S forms MnS finely precipitated particles which hinder transfer of the magnetic domain walls and the growth of fine precipitated particles from the application of strain to the sheet bar, S content should be as small as possible.

Any known additives, such as Sb, Sn, Bi, Ge, B, Ca, and rare earth metals, can be added to the steel to improve magnetic properties. The content of each additive is suitably not more than about 0.2 wt % in view of economic feasibility.

A sheet bar is formed from a slab having the above composition by directly rough-rolling the slab or after re-heating the slab. The sheet bar is wound into a coil having an inside diameter not less than about 100 mm and outside diameter not more than about 3,600 mm. The winding is conducted within a temperature range of about 850° to 1,150° C.

When the sheet bar temperature exceeds about 1,150° C., fine precipitated particle content increases during finishing hot rolling such that decreased uniformity in core loss within a coil and between coils results. On the other hand, a sheet bar coiling temperature less than about 850° C. is not effective due to prolonged time required to cancel non-homogeneous precipitated particles and textures.

A coiled sheet bar having an inside diameter of less than about 100 mm tends to form cracks or defects on the surface due to the larger curvature. A coiled sheet bar having an outside diameter of over about 3,600 mm exhibits poor temperature uniformity and experiences less strain during the coiling process, thereby inhibiting uniformity in magnetic properties and thickness.

By coiling the sheet bar under the above conditions, uniform core loss and thickness can be attained in a coiled, non-oriented magnetic steel sheet. In addition, by controlling the sheet bar coiling temperature so that the α-phase stability index G satisfies G>0, the average core loss as well as core loss uniformity will further improve. Thus, the sheet bar is preferably wound at a temperature satisfying G>0.

The sheet bar coiling temperature represents the sheet bar average temperature during coiling, and remains substantially unchanged during coiling and uncoiling in general. However, when the average sheet bar temperature decreases during an extended coiling time, at least one average temperature during coiling or uncoiling should satisfy G>0.

The coiled sheet bar is then unwound and hot-rolled for finishing to make hot-rolled sheet. Any self-annealing or hot-rolled sheet annealing may be incorporated as the need arises. The hot-rolled sheet annealing may be accomplished by either batch annealing (box annealing) or continuous annealing.

Thereafter, a sheet having a predetermined thickness, for example 0.5 mm, is obtained by one or more cold rolling steps, and may include optional intermediate annealing steps. Subsequently, finishing annealing is performed to form the final product.

Any insulating coating process may be performed after the finishing annealing. A continuous annealing may be preferably used for the finishing annealing in view of productivity and economics.

Furthermore, a light-rolling process involving a rolling reduction of about 3 to 15% may be performed after the finishing annealing or the insulating coating process. A rolling reduction of less than about 3% or over about 15% diminishes the light-rolling effect of improving core loss values through the growth of coarse grains during the straightening annealing treatment.

The invention will now be described through illustrative examples. The examples are not intended to limit the scope of the appended claims.

EXAMPLE 1

After adjusting the steel composition in a converter and vacuum degassing device, slabs were prepared by continuous casting. When the slab temperature fell to 300° C., the slabs were reheated in a reheating furnace. Then, sheet bars 30 mm thick were obtained by rough-rolling the reheated slabs. After coiling the sheet bars, hot-rolled sheets were prepared from the sheet bar coil by finishing hot rolling. Some of the hot-rolled sheets were annealed. The hot-rolled sheets were then cold-rolled to a thickness of 0.5 mm, and continuous annealing was performed at 850° C. for 30 seconds. The magnetic properties in the longitudinal direction and thickness of the coil products were measured. The length of the coil product was 4,000 m, and a measurement of the magnetic properties was carried out every 30 m on the coils.

Table 3 shows the results of the magnetic property evaluations and thickness measurements, in addition to slab composition and the conditions under which hot rolling and sheet bar coiling were conducted.

diately after rough-rolling. Among the Examples of the Invention, sample Nos. 1, 2, 8, 9, 13 and 14 satisfying G>0 exhibit excellent properties. Nos. 3 and 16, having a coiled sheet bar outside diameter over about 3,600 mm, failed to produce adequate sheet bar coiling effects. Nos. 4 and 12, having coiled sheet bar inside diameters under about 100 mm, formed many surface defects on the produced sheet. Furthermore, in No. 6, where the sheet bar coiling tempera-

TABLE 3

| Sample | Composition (%) | | | | | | Sheet bar coiling temperature | | | | |
|---|---|---|---|---|---|---|---|---|---|---|---|
| | | | | | | | | Coiling condition | | | |
| | | | | | | | Slab heating temperature | Temperature | Inside diameter | Outside diameter | α-phase stability index |
| No. | C | Si | Mn | P | S | Al | (°C.) | (°C.) | (mm) | (mm) | G |
| 1 | 0.0026 | 0.12 | 0.2 | 0.05 | 0.0031 | 0.25 | 1150 | 950 | 200 | 1500 | 2.01 |
| 2 | | | | | | | 1150 | 920 | 500 | 3500 | 7.36 |
| 3 | | | | | | | 1150 | 950 | 1500 | 3800 | 2.01 |
| 4 | | | | | | | 1150 | 950 | 90 | 800 | 2.01 |
| 5 | | | | | | | 1250 | 1000 | 500 | 1500 | −4.76 |
| 6 | | | | | | | 1150 | 820 | 500 | 1500 | 32.84 |
| 7 | | | | | | | 1150 | — | — | — | — |
| 8 | 0.003 | 0.5 | 0.5 | 0.05 | 0.002 | 0.6 | 1100 | 860 | 2000 | 3400 | 29.84 |
| 9 | | | | | | | 1100 | 950 | 150 | 2000 | 10.69 |
| 10 | | | | | | | 1100 | — | — | — | — |
| 11 | | | | | | | 1150 | 1060 | 800 | 2000 | −0.97 |
| 12 | | | | | | | 1100 | 950 | 90 | 800 | 10.69 |
| 13 | 0.003 | 2.5 | 0.5 | 0.01 | 0.002 | 0.3 | 1100 | 950 | 500 | 1500 | 25.86 |
| 14 | | | | | | | 1250 | 1100 | 500 | 1500 | 12.73 |
| 15 | | | | | | | 1100 | — | — | — | — |
| 16 | | | | | | | 1100 | 1000 | 2700 | 3800 | 19.09 |
| 17 | | | | | | | 1250 | 1180 | 500 | 1500 | 13.53 |

Note:
For Nos. 8 to 12, self annealing was performed on hot-rolled sheets at 850° C. for 30 minutes, and for Nos. 13 to 17, continuous annealing was performed on hot-rolled sheets at 950° C. for 90 seconds.
Underlining indicates values out of the claimed range or properties inferior to Examples of the Invention.
No sheet bar coiling was conducted for Nos. 7, 10 and 15.

| Sample No. | Magnetic induction $B_{50}$ | | Iron loss $W_{15/50}$ | | Sheet Thickness | | Surface defects | Remarks |
|---|---|---|---|---|---|---|---|---|
| | Average (X) (T) | Standard Deviation σ (T) | Average (X) (w/kg) | Standard Deviation σ (w/kg) | Average (X) (mm) | Standard Deviation σ (mm) | | |
| 1 | 1.772 | 0.001 | 5.65 | 0.03 | 0.50 | 0.001 | nil | Example of Invention |
| 2 | 1.770 | 0.001 | 5.50 | 0.02 | 0.50 | 0.001 | nil | Example of Invention |
| 3 | 1.755 | 0.004 | 6.21 | 0.19 | 0.50 | 0.003 | nil | Comparative Ex. |
| 4 | 1.771 | 0.001 | 5.60 | 0.03 | 0.50 | 0.001 | present | Comparative Ex. |
| 5 | 1.765 | 0.002 | 5.85 | 0.05 | 0.50 | 0.001 | nil | Example of Invention |
| 6 | 1.745 | 0.005 | 6.20 | 0.15 | 0.50 | 0.004 | nil | Comparative Ex. |
| 7 | 1.755 | 0.004 | 6.40 | 0.18 | 0.50 | 0.003 | nil | Comparative Ex. |
| 8 | 1.765 | 0.001 | 4.05 | 0.02 | 0.50 | 0.001 | nil | Example of Invention |
| 9 | 1.765 | 0.001 | 4.20 | 0.02 | 0.50 | 0.001 | nil | Example of Invention |
| 10 | 1.750 | 0.004 | 4.89 | 0.15 | 0.50 | 0.003 | nil | Comparative Ex. |
| 11 | 1.760 | 0.002 | 4.35 | 0.04 | 0.50 | 0.001 | nil | Example of Invention |
| 12 | 1.762 | 0.001 | 4.20 | 0.02 | 0.50 | 0.001 | present | Comparative Ex. |
| 13 | 1.688 | 0.001 | 2.81 | 0.02 | 0.50 | 0.001 | nil | Example of Invention |
| 14 | 1.689 | 0.001 | 2.85 | 0.02 | 0.50 | 0.001 | nil | Example of Invention |
| 15 | 1.655 | 0.004 | 3.35 | 0.08 | 0.50 | 0.004 | nil | Comparative Ex. |
| 16 | 1.670 | 0.003 | 3.22 | 0.09 | 0.50 | 0.003 | nil | Comparative Ex. |
| 17 | 1.655 | 0.004 | 3.26 | 0.08 | 0.50 | 0.002 | nil | Comparative Ex. |

Note:
For Nos. 8 to 12, self annealing was performed on hot-rolled sheets at 850° C. for 30 minutes, and for Nos. 13 to 17, continuous annealing was performed on hot-rolled sheets at 950° C. for 90 seconds.
Underlining indicates values out of the claimed range or properties inferior to the Examples of the Invention.
No sheet bar coiling was conducted for Nos. 7, 10 and 15.

Table 3 reveals that examples where sheet bar coiling was performed after rough-rolling have superior (smaller) standard deviations of the magnetic properties and thickness, and superior (larger) average magnetic property values compared to those comparative examples conventionally produced in that finishing hot rolling was carried out immeture was less than about 850° C., large deviations in the magnetic properties remained. Similarly, in No. 17, treated at a sheet bar coiling temperature over about 1,150° C., the averages and deviations of the magnetic properties are inferior to No. 13, which had a sheet bar coiling temperature less than about 1,150° C.

EXAMPLE 2

After adjusting the steel composition in a converter and vacuum degassing device, slabs were prepared by continuous casting. When the slab temperature fell to 850° C., the slabs were reheated in a reheating furnace. Then, sheet bars 30 mm thick were obtained by rough-rolling the reheated slabs. After coiling the sheet bars, hot-rolled sheets were prepared from the sheet bar coil by finishing hot rolling. Some of the hot-rolled sheets were annealed. The hot-rolled sheets were then cold-rolled, and continuous annealing was performed at 770° C. for 30 seconds, and thereafter a 5% light rolling was performed to obtain products 0.5 mm thick. Magnetic properties in the longitudinal direction and thickness of the coil products were measured.

Table 4 shows the results of the magnetic property evaluations and thickness measurements, in addition to slab compositions and the conditions under which hot rolling and sheet bar coiling were conducted.

TABLE 4

| Sample | Composition (%) | | | | | | Sheet bar coiling condition | | | | |
|---|---|---|---|---|---|---|---|---|---|---|---|
| | | | | | | | | Coiling condition | | | |
| | | | | | | | Slab heating temperature | Temperature | Inside diameter | Outside diameter | α-phase stability index |
| No. | C | Si | Mn | P | S | Al | (°C.) | (°C.) | (mm) | (mm) | G |
| 18 | 0.0026 | 0.12 | 0.2 | 0.05 | 0.003 | 0.25 | 1150 | 950 | 200 | 1500 | 2.01 |
| 19 | | | | | | | 1150 | 920 | 500 | 3500 | 7.36 |
| 20 | | | | | | | 1150 | 950 | 1500 | 3800 | 2.01 |
| 21 | | | | | | | 1150 | 950 | 90 | 800 | 2.01 |
| 22 | | | | | | | 1250 | 1000 | 500 | 1500 | −4.76 |
| 23 | | | | | | | 1150 | 820 | 500 | 1500 | 32.84 |
| 24 | | | | | | | 1150 | — | — | — | — |
| 25 | 0.003 | 0.5 | 0.5 | 0.05 | 0.002 | 0.6 | 1100 | 860 | 2000 | 3400 | 29.84 |
| 26 | | | | | | | 1100 | 950 | 150 | 2000 | 10.68 |
| 27 | | | | | | | 1100 | — | — | — | — |
| 28 | | | | | | | 1100 | 1060 | 800 | 2000 | −0.97 |
| 29 | | | | | | | 1100 | 950 | 90 | 800 | 10.69 |
| 30 | 0.003 | 2.5 | 0.5 | 0.01 | 0.002 | 0.3 | 1100 | 950 | 500 | 1500 | 25.86 |
| 31 | | | | | | | 1250 | 1100 | 500 | 1500 | 12.73 |
| 32 | | | | | | | 1100 | — | — | — | — |
| 33 | | | | | | | 1100 | 1000 | 2700 | 3800 | 19.09 |
| 34 | | | | | | | 1250 | 1180 | 500 | 1500 | 13.53 |

Note:
For Nos. 25 to 29, self annealing was performed on hot-rolled sheets at 850° C. for one hour, and for Nos. 30 to 34, continuous annealing was performed on hot-rolled sheets at 950° C. for 90 seconds.
Magnetic property measurements were carried out after straightening annealing at 850° C. for 2 hours.
Underlining indicates values out of the claimed range or properties inferior to the Examples of the Invention.
No sheet bar coiling was conducted for Nos. 24, 27 and 32.

| Serial No. | Skin pass Rolling reduction | Magnetic Induction $B_{50}$ Average (X) (T) | Magnetic Induction $B_{50}$ Standard Deviation σ (T) | Iron loss $W_{15/50}$ Average (X) (w/kg) | Iron loss $W_{15/50}$ Standard Deviation σ (w/kg) | Sheet Thickness Average (X) (mm) | Sheet Thickness Standard Deviation σ (mm) | Surface defects | Remarks |
|---|---|---|---|---|---|---|---|---|---|
| 18 | 8 | 1.770 | 0.001 | 4.56 | 0.03 | 0.50 | 0.001 | nil | Example of the Invention |
| 19 | 5 | 1.765 | 0.001 | 4.55 | 0.02 | 0.50 | 0.001 | nil | Example of the Invention |
| 20 | 8 | 1.745 | 0.003 | 5.30 | 0.15 | 0.50 | 0.003 | nil | Comparative Ex. |
| 21 | 10 | 1.768 | 0.001 | 4.50 | 0.03 | 0.50 | 0.001 | present | Comparative Ex. |
| 22 | 8 | 1.760 | 0.002 | 4.75 | 0.04 | 0.50 | 0.001 | nil | Example of the Invention |
| 23 | 7 | 1.735 | 0.005 | 5.30 | 0.15 | 0.50 | 0.004 | nil | Comparative Ex. |
| 24 | 5 | 1.740 | 0.005 | 5.21 | 0.18 | 0.50 | 0.004 | nil | Comparative Ex. |
| 25 | 8 | 1.760 | 0.001 | 3.05 | 0.02 | 0.50 | 0.001 | nil | Example of the Invention |
| 26 | 2 | 1.762 | 0.001 | 3.77 | 0.02 | 0.50 | 0.001 | nil | Example of the Invention |
| 27 | 10 | 1.740 | 0.004 | 4.85 | 0.13 | 0.50 | 0.003 | nil | Comparative Ex. |
| 28 | 10 | 1.755 | 0.002 | 3.21 | 0.04 | 0.50 | 0.001 | nil | Example of the Invention |
| 29 | 10 | 1.762 | 0.001 | 3.08 | 0.02 | 0.50 | 0.001 | present | Comparative Ex. |
| 30 | 8 | 1.768 | 0.001 | 2.65 | 0.02 | 0.50 | 0.001 | nil | Example of the Invention |
| 31 | 18 | 1.640 | 0.001 | 3.05 | 0.02 | 0.50 | 0.001 | nil | Example of the Invention |
| 32 | 12 | 1.640 | 0.004 | 3.25 | 0.09 | 0.50 | 0.004 | nil | Comparative Ex. |
| 33 | 8 | 1.648 | 0.003 | 3.05 | 0.08 | 0.50 | 0.003 | nil | Comparative Ex. |
| 34 | 8 | 1.645 | 0.004 | 3.12 | 0.08 | 0.50 | 0.002 | nil | Comparative Ex. |

Note:
For Nos. 25 to 29, self annealing was performed on hot-rolled sheets at 850° C. for one hour, and for Nos. 30 to 34, continuous annealing was performed on hot-rolled sheets at 950° C. for 90 seconds.
Magnetic property measurements were carried out after straightening annealing at 850° C. for 2 hours.
Underlining represents the conditions out of the claimed range or properties inferior to the Examples of the Invention.
No sheet bar coiling was conducted for Nos. 24, 27 and 32.

Table 4 reveals that examples where sheet bar coiling was performed after rough-rolling have superior (smaller) standard deviations of the magnetic properties and thickness, and superior (larger) average magnetic property values compared to those comparative examples conventionally produced in that hot rolling finishing was carried out immediately after rough-rolling. Among the Examples of the Inventions, sample Nos. 18, 19, 25 and 30 satisfying G>0 exhibited excellent properties. Nos. 20 and 33, having a coiled sheet bar outside diameter over about 3,600 mm, failed to produce adequate sheet bar effects. Nos. 21 and 29, having coiled sheet bar diameters under about 100 mm, formed many surface defects on the produced sheet. Furthermore, in No. 23, where the sheet bar coiling temperature was less than about 850° C., large deviations in the magnetic properties remained. Similarly, in No. 34, treated at a sheet bar coiling temperature over about 1,150° C., the averages and deviations of the magnetic properties are inferior to No. 30, which had a sheet bar coiling temperature less than about 1,150° C.

Although this invention has been described in connection with specific forms thereof, it will be appreciated that a wide variety of equivalents may be substituted for the specific elements described herein without departing from the spirit and scope of this invention defined in the appended claims.

What is claimed is:

1. In a method of producing a non-oriented magnetic steel sheet, including:

producing a steel slab having a steel slab composition;

hot rolling said steel slab to form a hot-rolled steel sheet;

cold rolling said hot-rolled steel sheet at least once to form a cold-rolled steel sheet; and finish annealing said cold-rolled steel sheet to form said non-oriented magnetic steel sheet;

the steps which comprise:

controlling said steel slab composition to comprise no more than about 0.01 wt % C, no more than about 4.0 wt % Si, no more than about 1.5 wt % Mn, no more than about 1.5 wt % Al, no more than about 0.2 wt % P, and no more than about 0.01 wt % S;

said hot rolling including rough-rolling said steel slab to form a sheet bar, applying strain to said sheet bar, and thereafter maintaining said sheet bar at a temperature ranging from about 850° C. to 1,150° C.

2. In a method of producing a non-oriented magnetic steel sheet, including:

producing a steel slab having a steel slab composition;

hot rolling said steel slab to form a hot-rolled steel sheet;

cold rolling said hot-rolled steel sheet at least once to form a cold-rolled steel sheet; and finish annealing said cold-rolled steel sheet to form said non-oriented magnetic steel sheet;

the steps which comprise:

controlling said steel slab composition to comprise no more than about 0.01 wt % C, no more than about 4.0 wt % Si, no more than about 1.5 wt % Mn, no more than about 1.5 wt % Al, no more than about 0.2 wt % P, and no more than about 0.01 wt % S;

said hot rolling including rough-rolling said steel slab to form a sheet bar, coiling said sheet bar into a coil while said sheet bar is at a temperature ranging from about 850° to 1,150° C., said coil having an inside diameter of no less than about 100 mm and an outside diameter of no greater than about 3,600 mm, uncoiling said coil to form an uncoiled sheet bar, and finish hot rolling said uncoiled sheet bar.

3. A method for producing a non-oriented magnetic steel sheet according to claim 2, wherein said coiling of said sheet bar is performed at a temperature T (° C.) which satisfies the following relationship:

$$900.31 - 2.0183T + 1.4139 \times 10^{-3}T^2 - 3.0648 \times 10^{-7}T^3 - 326.7[\text{C wt \%}] + 11.8[\text{Si wt \%}] - 12.2[\text{Mn wt \%}] + 39.7[\text{P wt \%}] + 22.8[\text{Al wt \%}] > 0$$

4. A method for producing a non-oriented magnetic steel sheet according to claim 1, wherein a light rolling involving a rolling reduction of about 3 to 15% is performed after said finish annealing.

5. A method for producing a non-oriented magnetic steel sheet according to claim 2, wherein a light rolling involving a rolling reduction of about 3 to 15% is performed after said finish annealing.

6. A method for producing a non-oriented magnetic steel sheet according to claim 3, wherein a light rolling involving a rolling reduction of about 3 to 15% is performed after said finish annealing.

* * * * *

UNITED STATES PATENT AND TRADEMARK OFFICE

CERTIFICATE OF CORRECTION

PATENT NO. : 5,637,157

DATED : June 10, 1997

INVENTOR(S) : Minoru Takashima et al

It is certified that error appears in the above-indentified patent and that said Letters Patent is hereby corrected as shown below:

On the title page, at [57] Abstract, line 14, please change "150° C" to --1150° C--.

Signed and Sealed this

Twenty-eighth Day of October, 1997

*Attest:*

Bruce Lehman

BRUCE LEHMAN

*Attesting Officer*

*Commissioner of Patents and Trademarks*